US006438211B1

(12) United States Patent
Weekamp et al.

(10) Patent No.: US 6,438,211 B1
(45) **Date of Patent: *Aug. 20, 2002**

(54) X-RAY APPARATUS INCLUDING A FILTER WITH FILTER ELEMENTS HAVING AN ADJUSTABLE ABSORPTIVITY

(75) Inventors: Johannus Wilhelmus Weekamp; Menno Willem Jose Prins, both of Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/686,827

(22) Filed: Oct. 11, 2000

(30) Foreign Application Priority Data

Oct. 18, 1999 (EP) ..... 99203409

(51) Int. Cl.[7] ..... G21K 3/00
(52) U.S. Cl. ..... 378/158; 378/156
(58) Field of Search ..... 378/156, 157, 378/158, 159, 145

(56) References Cited

U.S. PATENT DOCUMENTS 5,625,665 A 4/1997 Fokkink et al. ..... 378/156
5,666,396 A 9/1997 Linders et al. ..... 378/156
5,751,786 A * 5/1998 Welters et al. ..... 378/156
2001/0024486 A1 * 9/2001 Herbert ..... 378/158

* cited by examiner

*Primary Examiner*—Robert H. Kim
*Assistant Examiner*—C Kao
(74) *Attorney, Agent, or Firm*—John Vodopia

(57) ABSTRACT

An X-ray apparatus includes an X-ray source for producing a beam of X-rays, an X-ray detector for detecting this radiation, and an X-ray filter with filter elements which is arranged between the X-ray source and the X-ray detector so as to attenuate the X-ray beam in each independent filter element individually. Each filter element can contain a liquid filling (22) which is electrically conductive and X-ray absorbing, the value of the X-ray absorptivity of each filter element being discretely adjustable by step-wise adjustment of the level of the liquid filling within each filter element. Each filter element includes an electrode (23) which is positioned between an isolator layer (34) and a substrate (38) in a wall of the filter element in order to apply an electric potential to the wall of this element. Another electric potential is applied to the liquid filling. Therefore, an electric capacitance can be defined per unit of surface area of the filter element. In order to achieve step-wise filling of the filter element, in accordance with the invention the electric capacitance per unit of surface area of the filter element is varied in its longitudinal direction z. This is realized, for example, by subdividing the electrode (23) into electrode segments of different surface area in the longitudinal direction z of the filter element, the first electrode segment (37) having a surface area which is larger than that of the second electrode segment (39).

4 Claims, 4 Drawing Sheets

X-RAY APPARATUS INCLUDING A FILTER WITH FILTER ELEMENTS HAVING AN ADJUSTABLE ABSORPTIVITY

BACKGROUND OF INVENTION

The invention relates to an X-ray apparatus which includes an X-ray source for producing X-rays, an X-ray detector for detecting the X-rays, and a filter which is arranged between the X-ray source and the X-ray detector and includes a plurality of tubular filter elements having a longitudinal direction and a circumference, wherein each filter element has an internal volume for receiving a liquid filling which contains at least one electrically conductive and one X-ray absorbing liquid component, the X-ray absorptivity of said filter element being dependent on the quantity of X-ray absorbing liquid component present in the internal volume, each filter element is provided with a first electrode for applying a first electric voltage to a wall of the filter element and a second electrode for applying a second electric voltage to the internal volume of the filter element, the first electrode is electrically isolated from the internal volume of the filter element by means of an isolator layer in such a manner that an electric capacitance per unit of surface area of the filter element exists between the first electrode and the electrically conductive liquid component when a quantity of the electrically conductive liquid component is present in at least a part of the internal volume of the filter element, the X-ray absorptivity of each filter element is adjustable by step-wise control of a surface level of the X-ray absorbing liquid component in the longitudinal direction of each filter element.

An X-ray apparatus with an X-ray filter of this kind is known from U.S. Pat. No. 5,666,396 (PHN 15.378). The known X-ray apparatus includes a filter with a plurality of filter elements, each having an individual absorptivity which is being dependent on the level of a liquid filling present in the filter element. The X-ray apparatus is used inter alia for medical diagnostic imaging where a patient to be examined is arranged between the X-ray source and the X-ray detector in order to image internal structures. Because of the fact that there are structures of different electron density present within the patient, areas of different density are observed in a resultant X-ray image. The difference in density between the extreme values of the density in one X-ray image is defined as the dynamic range. The filter serves to limit a dynamic range per X-ray image.

In order to limit the dynamic range of the object to be examined, the known X-ray apparatus includes a filter with filter elements provided with a bundle of tubes for receiving a liquid filling which is X-ray absorbing as well as electrically conductive; each tube is connected to a common supply duct. Each filter element is provided with a first electrode which is arranged in a wall of the filter element in order to apply an electric voltage to the wall of the filter element. A second electrode is in contact with the liquid filling. The electric voltage applied to the first electrode of the filter element influences the adhesion between the liquid filling and an inner wall of the filter element; this adhesion determines whether the relevant filter element is filled with the liquid filling. The relative quantity of the liquid filling in individual filter elements is controlled on the basis of the electric voltages applied to the individual filter elements. For example, for a first value of the electric voltage the adhesion to the inner wall for the liquid filling is increased and the relevant filter element is filled with the liquid filling from the supply duct. For a second value of the electric voltage the adhesion is reduced and the liquid filling is drained from the filter element to the supply duct. The filter elements are adjusted to a high X-ray absorptivity by filling them with the liquid filling; they are adjusted to a low X-ray absorptivity by keeping filter elements empty.

It is a drawback of the known device that the filling of each filter element is controlled by application of a sequence of electric voltage pulses to the first electrode of the filter element so that the filter element is electrically charged. The level of the electric charge determines the degree of filling of the filter element. It has been found that in the course of time the filling level of the filter element becomes poorly reproducible. In many practical cases it is desirable to have a reproducible filling with an a priori known degree of discretization so as to realize a reliable range of gray scale values.

SUMMARY OF INVENTION

It is an object of the invention to provide an X-ray apparatus which includes a filter provided with filter elements whose X-ray absorptivity can be controlled in steps.

An X-ray apparatus according to the invention is characterized in that the electric capacitance per unit of surface area of the wall of the filter element varies substantially in the longitudinal direction of the filter element.

The invention utilizes the known effect that a contact angle between an electrically conductive liquid and an electrode which is isolated therefrom is changed by creating a potential difference between the electrically conductive liquid and the electrode. This phenomenon is known as electrowetting. When electrowetting is applied to a tubular filter element which has an electrode provided in its wall and is filled with an electrically conductive liquid filling, the level of said liquid filling in the filter element can be influenced due to the fact that the electrowetting force is oriented in the longitudinal direction of the filter element so that the degree of filling of the filter element can be increased or decreased at option. In order to realize the potential difference between the liquid filling and the first electrode provided in the wall of the filter element, they are electrically isolated from one another by means of an isolator layer deposited on the inner wall of the filter element. In order to achieve a low wetting hysteresis, the isolator layer may also be covered by an inert cover layer so that the liquid filling directly contacts the cover layer. A capacitance per unit of surface area of the filter element which is due to the geometry of the filter element can then be defined. It is known that in electrowetting a balance exists between the capillary force, the force of gravity and the electric capillary force or electrowetting force. The relationship between the level of the electrically conductive liquid filling in the filter element and the relevant physical quantities can be derived from the equations for the energy balance in the filter element. There can be defined two dominant variables whose value determines the electrowetting force in the filter element. The first variable is the capacitance per unit of surface area which is averaged over the length of the contact edge between the meniscus of the electrically conductive liquid filling and the inert cover layer. The second variable is the potential difference between the electrically conductive liquid filling and the first electrode. The invention is based on the idea to realize the filter element filling in steps by step-wise varying the capacitance, and hence the minimum potential difference necessary for electrowetting to occur, in the longitudinal direction of the filter element.

The procedure for the step-wise filling of the filter element is as follows. The operation of the filter element will be described first of all for the case where the liquid filling contains two liquid components that can fully dissolve in one another, thus forming one electrically conductive and X-ray absorbing liquid. It is also assumed that the filter element is empty, that the capacitance variation profile in the longitudinal direction of the filter element is known a priori, and that no potential difference exists yet between the liquid filling and the first electrode. Finally, a distinction is made between a "fill" voltage for completely filling the filter element, a "hold" voltage for keeping the liquid filling in position, and a "drain" voltage for draining the filter element. The duration of the voltage pulse of the "drain" voltage or the "fill" voltage determines the volume of the filling. A relevant control chart is as follows: during step one a voltage is applied to the first electrode in such a manner that all filter elements are filled (the "fill" voltage). Subsequently, the voltage for all filter elements is lowered to the "hold" voltage. Finally, per individual filter element the pulses of the "drain" voltage are applied with a pulse duration such that the liquid filling is lowered to the required level.

It is alternatively possible to form the liquid filling from more, notably two, liquid components which are not miscible. In that situation, for example the properties of the liquid components can be individually optimized so that, for example, one liquid component has optimum electrical conductivity properties and hardly absorbs X-rays whereas the second liquid component has optimum X-ray absorbing properties and is electrically insulating. This situation can also be used to make one of the liquid components electrically conductive as well as X-ray absorbing and to choose the second liquid component to be such that it prevents degradation of the inert cover layer. The respective liquid columns may then be contiguous so that a common interface is formed in the transverse direction. However, it is also feasible for the two liquid components to remain separated by a gas layer. Furthermore, it must be possible to supply the liquid components from a respective supply duct. In that case the filter element is always filled with the liquid filling, the degree of the X-ray absorption being determined by the level of the X-ray absorbing liquid component in the filter element. The operation of the filter element is then similar to that according to the described control chart. According to this method the level of the X-ray absorbing liquid component is determined passively by the level of the electrically conductive liquid component in the filter element and the maximum X-ray absorption is reached when the filter element is completely filled with the X-ray absorbing liquid component.

One method of varying the mean capacitance per unit of surface area consists in locally changing the surface area of the electrode relative to the surface area of the tubular filter element, for example by means of electrode constrictions. To this end, a first embodiment of the X-ray apparatus according to the invention is characterized in that the first electrode includes a number of electrically interconnected first and second electrode segments, each of which extends at least over a part of the circumference of the tubular filter element, the first and the second electrode segments being arranged so as to succeed one another in the longitudinal direction of the filter element, and that the first electrode segment extends over a larger part of the circumference of the filter element in comparison with the second electrode segment.

Another method of varying the capacitance per unit of surface area consists in the use of a number of different isolator materials. A further embodiment is characterized in that the isolator layer includes a number of first and second isolator segments, the first and second isolator segments succeeding one another in the longitudinal direction of the filter element, the first isolator segment having a dielectric constant which is higher than that of the second isolator segment.

It is alternatively possible to vary the capacitance per unit of surface area by varying a distance between the liquid filling and the first electrode. This is the case in a third embodiment which is characterized in that the isolator layer includes a number of first and second isolator layer segments, the first and second isolator layer segments succeeding one another in the longitudinal direction of the filter element and the first isolator layer segment having a layer thickness which is larger than that of the second isolator layer segment.

BRIEF DESCRIPTION OF DRAWINGS

These and other aspects of the invention will be elucidated and described on the basis of the following embodiments and the accompanying drawing; therein.

DETAILED DESCRIPTION

Figure 1:
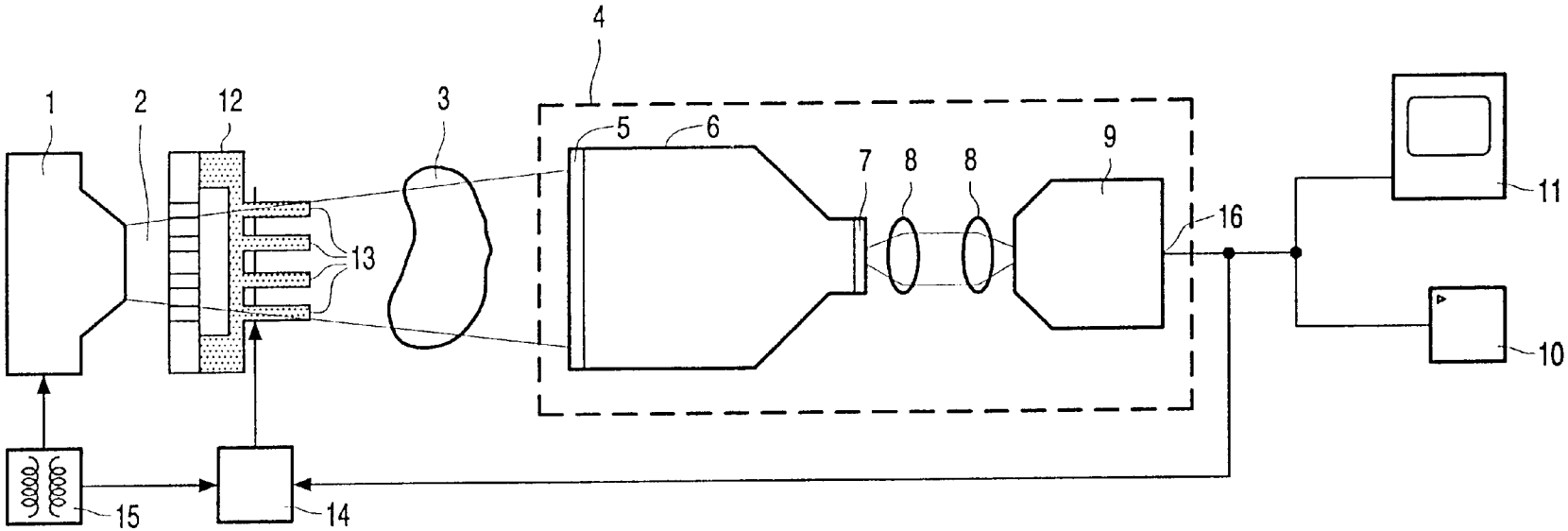
FIG. 1 shows diagrammatically an X-ray apparatus according to the invention.

FIG. 1 shows diametrically an X-ray apparatus which includes a filter in accordance with the invention. The X-ray source 1 emits an X-ray beam 2 which irradiates an object 3, for example a patient to be examined. As a result of local differences in the absorption of X-rays in the object 3 and X-ray image is formed on the X-ray detector 4 which in this case an image intensifier 6 and is converted into a light image on the exit window 7; this light image is imaged on a video camera 9 by means of a lens system 8. The video camera 9 forms an electronic image signal from the light image. The electronic image signal is applied, for example for further processing, to an image processing unit 10 or to a monitor 11 on which the image information in the X-ray image is displayed.

Between the X-ray source 1 and the object 3 there is arranged a filter 12 for local attenuation of the X-ray beam 2. The filter 12 includes various tubular filter elements 13 whose X-ray absorptivity can be adjusted by application of electric voltages to the wall of the filter elements by means of an adjusting circuit 14. The electric voltages are adjusted, for example on the basis of the setting of the X-ray source 1, by means of the power supply 15 of the X-ray source and/or on the basis of, for example brightness values of the X-ray image which can be derived from the signal present on the output terminal 16 of the video camera 9. The general construction of a filter 12 of this kind and the composition of the liquid filling thereof are described in greater detail in U.S. Pat. No. 5,625,665 (PHN 15.044).

Figure 2A:
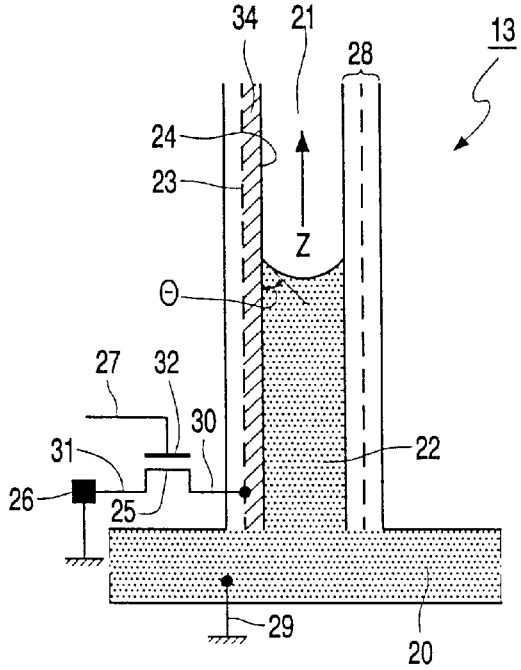
FIG. 2*a* is a diagrammatic sectional view of a filter element of the filter of FIG. 1 which is filled with a liquid filling consisting of one liquid component.

FIG. 2*a* is a diagrammatic sectional view of the tubular filter element 13 of a filter as shown in FIG. 1. The filter element 13 is filled, via the supply duct 20, with the liquid filling 22 which is formed by one electrically conductive and X-ray absorbing liquid. For each filter element the longitudinal direction z and the internal volume 21 are defined, the latter being bounded by the walls 28 of the filter element. Each filter element includes the first electrode 23 in the form of an electrically conductive layer which is electrically isolated from the liquid filling in the internal volume 21 by means of an isolator layer 34, an inert cover layer 24 which is provided on an inner side of the walls 28, and a second electrode 29 for applying an electric potential to the liquid filling. The electrically conductive layer 23 of the filter element 13 is coupled to a switching element which, in the present embodiment, is formed by a drain contact 30 of a field effect transistor 25 whose source contact 31 is coupled to a power supply circuit 26. The field effect transistor 25 is turned on, i.e. the switching element is closed, by means of a control voltage which is applied, via the control line 27, to a gate contact 32 of the field effect transistor 25. The electric voltage of the voltage line 26 is applied to the electrically conductive layer 23 by closing the switching element. When the voltage line is adjusted to the value of the "filling" voltage, the contact angle θ between the liquid filling 22 and the inert cover layer 24 decreases and the relevant filter element is filled with the liquid filling.

Figure 2B:
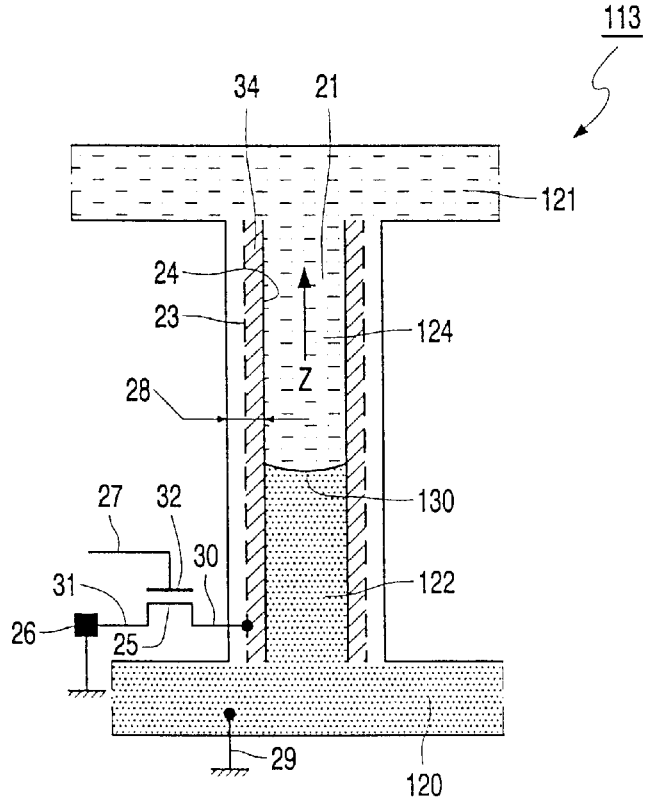
FIG. 2*b* is a diagrammatic sectional view of a filter element of the filter shown in FIG. 1 which is filled with a liquid filling consisting of two liquid components.

FIG. 2*b* is a diagrammatic sectional view of the tubular filter element 113 of a filter as shown in FIG. 1 in case the filter element is filled with a liquid filling composed of an electrically conductive liquid component 122 and an X-ray absorbing liquid component 124 which is not miscible therewith. The liquid components are supplied via respective supply ducts 120 and 121. The other functional parts of the filter element 113 are substantially identical to those of the filter element 13, so that the control chart for the electrically conductive liquid component can be executed in a similar manner. This control chart determines the level of the electrically conductive liquid component 122 in the internal volume 21 of the filter element 113 which in its turn determines the level of the X-ray absorbing liquid component 124 in the filter element 113, because the respective components constitute one common liquid column with an interface 130. The degree of X-ray absorption is in this case determined by the degree of filling of the filter element 113 with the X-ray absorbing component 124.

Figure 3A:
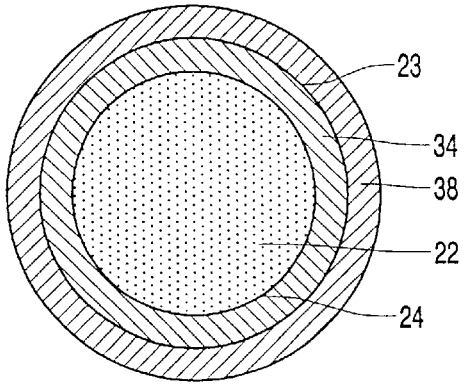
FIGS. 3*a* and 3*b* show diagrammatically the geometry of the filter element and a 360° view of the first electrode provided with electrode constrictions.
Figure 3B:
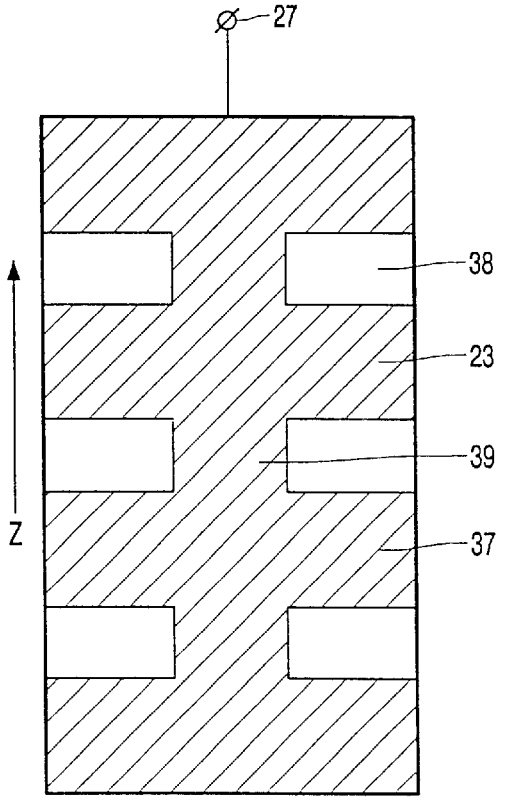

FIG. 3*a* is a diagrammatic cross-sectional view of a first embodiment of the tubular filter element 13. In this embodiment the filter element 13 has a circular cross-section whereas, generally speaking, the cross-section of the filter element may be a polygon. The filter element contains the liquid filling 22 which is in contact with the inert cover layer 24. The liquid filling is electrically isolated from the first electrode 23 by means of the isolator layer 34; this involves a capacitance per unit of surface area of the filter element. The electrode 23 is provided on a substrate 38. FIG. 3*b* is a 360° view of the projection of the electrode 23 on the substrate 38. In order to enable local variation of the capacitance per unit of surface area in the longitudinal direction z of the filter element, the electrode 23 in this embodiment is subdivided into successive first electrode segments 37 and second electrode segments 39 of different surface area. The voltage line 27 enables application of the electric voltage to the electrode 23.

Figure 4:
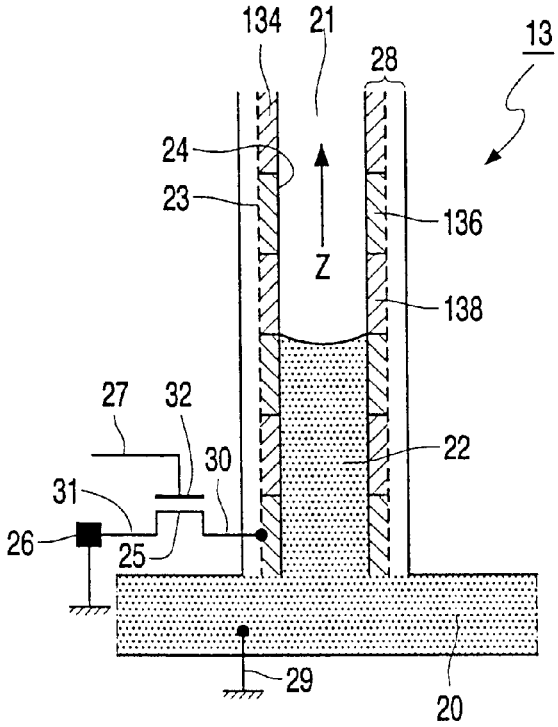
FIG. 4 is a diagrammatic sectional view of the filter element provided with an isolator layer composed of different isolator segments.

FIG. 4 is a diagrammatic sectional view of a second embodiment of the filter element 13. The filter element in this embodiment is provided with an isolator layer which is composed of different isolator segments. The isolator layer 134 is subdivided into first isolator segments 136 and second isolator segments 138 which succeed one another in the longitudinal direction z of the filter element. The first isolator segment 136 has a dielectric constant which is higher than that of the second isolator segment 138, thus enabling a local variation of the capacitance per unit of surface area in the longitudinal direction of the filter element. This step enables the step-wise filling of the filter element 13 with the liquid filling 22.

Figure 5:
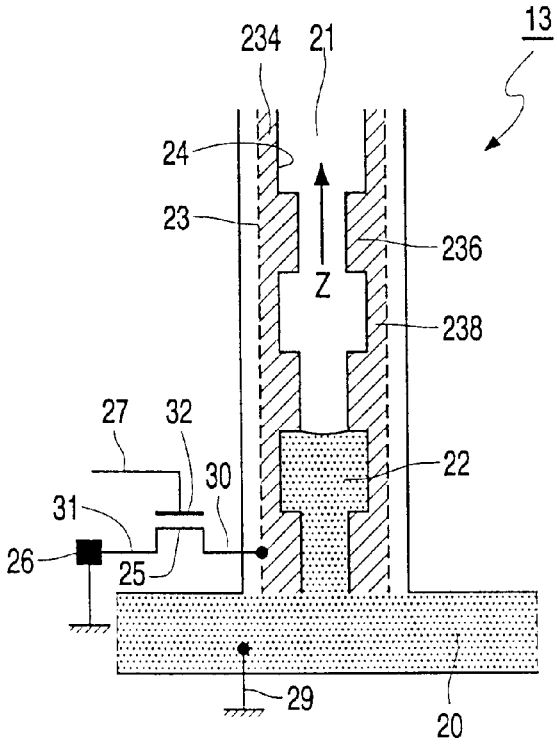
FIG. 5 is a diagrammatic sectional view of the filter element provided with an isolator layer composed of isolator layer segments of different thickness.

FIG. 5 is a diagrammatic sectional view of the third embodiment of the filter element 13 which is provided with an isolator layer composed of different isolator layer segments. The isolator layer 234 is subdivided into first isolator layer segments 236 and second isolator layer segments 238 which succeed one another in the longitudinal direction of the filter element. The thickness of the first isolator layer segment 236 is greater than that of the second isolator segment 238, thus enabling a local variation of the capacitance per unit of surface area in the longitudinal direction of the filter element. This step enables the step-wise filling of the filter element 13 with the liquid filling 22. In order to realize an optimum effect of this embodiment it is advantageous when the diameter of the tubular filter element 13 is reduced only slightly at the area of the first isolator layer segment 236.

What is claimed is:

1. An X-ray apparatus which includes an X-ray source (1) for producing X-rays (2), an X-ray detector (4) for detecting the X-rays, and a filter (14) which is arranged between the X-ray source and the X-ray detector and includes a plurality of tubular filter elements (13) having a longitudinal direction z and a circumference, wherein each filter element has an internal volume (21) for receiving a liquid filling (22) which contains at least one electrically conductive and one X-ray absorbing liquid component, the X-ray absorptivity of said filter element being dependent on the quantity of X-ray absorbing liquid component present in the internal volume (21), each filter element is provided with a first electrode (23) for applying a first electric voltage to a wall (28) of the filter element and a second electrode (29) for applying a second electric voltage to the internal volume (21) of the filter element, the first electrode is electrically isolated from the internal volume (21) of the filter element by means of an isolator layer (34) in such a manner that an electric capacitance per unit of surface area of the filter element exists between the first electrode (23) and the electrically conductive liquid component when a quantity of the electrically conductive liquid component is present in at least a part of the internal volume of the filter element (13), the X-ray absorptivity of each filter element (13) is adjustable by step-wise control of a surface level of the X-ray absorbing liquid component in the longitudinal direction z of each filter element, characterized in that the electric capacitance per unit of surface area of the wall (28) of the filter element (13) varies substantially in the longitudinal direction z of the filter element.

2. An X-ray apparatus as claimed in claim 1, wherein the first electrode (23) includes a number of electrically interconnected first and second electrode segments, each of which extends at least over a part of the circumference of the tubular filter element (13), the first and the second electrode segments being arranged so as to succeed one another in the longitudinal direction z of the filter element and that the first electrode segment (37) extends over a larger part of the circumference of the filter element in comparison with the second electrode segment (39).

3. An X-ray apparatus as claimed in claim 1, wherein the isolator layer (134) includes a number of first and second isolator segments, the first and second isolator segments succeeding one another in the longitudinal direction z of the filter element (13), the first isolator segment (136) having a dielectric constant which is higher than that of the second isolator segment (138).

4. An X-ray apparatus as claimed in claim 1, wherein the isolator layer (234) includes a number of first and second isolator layer segments, the first and second isolator layer segments succeeding one another in the longitudinal direction z of the filter element (13) and the first isolator layer segment (236) having a layer thickness which is larger than that of the second isolator layer segment (238).

* * * * *